US009344819B2

(12) United States Patent
Michel et al.

(10) Patent No.: US 9,344,819 B2
(45) **Date of Patent: *May 17, 2016**

(54) ADJUSTABLE SECURING MECHANISM FOR A SPACE ACCESS DEVICE

(71) Applicant: EARGO, INC., Mountain View, CA (US)

(72) Inventors: Florent Michel, Annemasse (FR); Raphael Michel, Palo Alto, CA (US); Daniel Shen, Stanford, CA (US); Michael Perry, Los Altos, CA (US)

(73) Assignee: Eargo, Inc., Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/874,838

(22) Filed: Oct. 5, 2015

(65) Prior Publication Data

US 2016/0029134 A1 Jan. 28, 2016

Related U.S. Application Data

(63) Continuation-in-part of application No. 14/032,310, filed on Sep. 20, 2013, and a continuation of application No. 13/865,717, filed on Apr. 18, 2013, now Pat. No. 8,577,067, and a continuation of application No. 12/841,120, filed on Jul. 21, 2010, now Pat. No. 8,457,337.

(51) Int. Cl.

| | |
|---|---|
| ***H04R 25/00*** | (2006.01) |
| ***H04R 25/02*** | (2006.01) |
| *H04R 1/42* | (2006.01) |

(52) U.S. Cl.

CPC ..... *H04R 25/652* (2013.01); *H04R 25/02* (2013.01); *H04R 25/606* (2013.01); *H04R 25/656* (2013.01); *H04R 1/42* (2013.01); *H04R 25/456* (2013.01); *H04R 25/658* (2013.01); *H04R 2460/09* (2013.01); *H04R 2460/11* (2013.01); *H04R 2460/13* (2013.01); *H04R 2460/17* (2013.01)

(58) Field of Classification Search

CPC ..... H04R 1/1016; H04R 25/60; H04R 25/65; H04R 25/456; H04R 25/604; H04R 25/652; H04R 25/654; H04R 25/658; H04R 2225/025

USPC ..... 381/322, 328; 181/130, 135

See application file for complete search history.

(56) References Cited

U.S. PATENT DOCUMENTS

| | | | | |
|---|---|---|---|---|
| 5,572,594 A * | 11/1996 | Devoe | H04R 25/656 181/130 |
| 5,881,159 A * | 3/1999 | Aceti | A61B 5/6817 381/322 |
| 6,879,695 B2 * | 4/2005 | Maltan | H04R 25/606 381/322 |
| 2004/0052391 A1 * | 3/2004 | Bren | H04R 25/43 381/331 |

* cited by examiner

*Primary Examiner* — Brian Ensey
(74) *Attorney, Agent, or Firm* — Francis Law Group

(57) ABSTRACT

A securing mechanism comprising a plurality of outwardly projecting members having a plurality of contact points that are configured to contact a surface of an opening when disposed on a space access device that is inserted in the opening, the securing mechanism being configured to apply a pressure to a contact surface within the opening less than approximately 10000 kPa.

4 Claims, 3 Drawing Sheets

ADJUSTABLE SECURING MECHANISM FOR A SPACE ACCESS DEVICE

CROSS-REFERENCES TO RELATED APPLICATIONS

This application is a continuation-in-part of U.S. application Ser. No. 14/032,310, filed on Aug. 20, 2012.

FIELD OF THE INVENTION

The present invention relates to systems and methods for securing devices in internal openings. More particularly, the present invention relates to apparatus, systems and methods for securing devices and systems in biological and non-biological spaces and openings.

BACKGROUND OF THE INVENTION

As is well known in the art, many space access devices and systems are designed and configured to be inserted in one or more biological spaces or openings, such as an ear canal, nasal opening, etc. Such devices include hearing aids, ear phones or buds, and oxygen nasal cannula.

Various space access devices and systems are also designed and configured to be inserted in non-biological spaces or openings, such a fluid flow lines and conduits. Such devices include conduit inspection and energy, e.g. heat, generating and/or dissipating systems.

The noted devices and systems often include means of securing the devices and/or systems in internal spaces or openings for a desired period of time, e.g. 1-2 minutes, 24 hours, 1 month, 1 year, etc. Such securing means include, for example, securing rings disposed on the outer surface of the devices, compliant outer layers, and/or conical fins that are adapted to removably secure the device(s) to an interior surface of a space or opening, e.g., an ear canal.

There are, however, a number of significant drawbacks and disadvantages associated with conventional securing means. A major disadvantage of conventional securing means is that the securing means, e.g., securing rings and compliant outer surfaces, do not include any means for fluid flow through the device or between the device and the internal space or opening when the device is inserted therein. Another drawback is that most of the devices employing the conventional securing means are easily dislodged.

Another drawback is that most of the devices employing the conventional securing means do not self-adjust or self-conform to the shape of the internal space or opening when the device is inserted therein. Indeed, most known securing devices either have a preset circular shape that may conform adequately to the shape of a space or opening, or are custom made to conform to (or match) the shape of a space or opening.

A further drawback is that most of the conventional securing means do not include any means for adjusting the force applied to the surface of the space or opening to secure the device therein. Indeed, virtually all known securing means are designed and adapted to apply a predetermined narrow range of force to a space or opening.

It would thus be desirable to provide space access devices and systems having securing means that (i) securely engage a surface of an internal space or opening for an extended period of time, (ii) include means to self-conform or self-adjust to the shape of an internal space or opening, (iii) include means for adjusting the force applied to a surface of an internal space or opening, and (iv) include means for fluid flow through the device and/or between the device and a space or opening when the device is inserted therein.

It is therefore an object of the present invention to provide improved securing means that can be readily employed with devices and systems that are configured to be inserted in one or more biological spaces or openings, such as an ear canal.

It is another object of the present invention to provide space access devices and systems having securing means that securely engage a surface of an internal space or opening for an extended period of time.

It is another object of the present invention to provide space access devices and systems having means to self-conform or self-adjust to the shape of an internal space or opening.

It is another object of the present invention to provide space access devices and systems that include means for adjusting the force applied to a surface of an internal space or opening.

It is another object of the present invention to provide space access devices and systems that include means for fluid flow through the device and/or between the device and a space or opening when the device is inserted therein.

SUMMARY OF THE INVENTION

The present invention is directed to securing mechanisms that can be readily employed with devices and systems that are configured to be inserted in one or more biological spaces or openings, such as an ear canal.

The present invention is also directed to space access devices and systems having a securing mechanism that (i) engages a surface of an internal space or opening for an extended period of time, (ii), include means to self-conform or self-adjust to the shape and size of an internal space or opening, (iii) includes means for adjusting the force (i.e. securing force) applied to a surface of an internal space or opening, and (iv) includes means for fluid flow through the device and/or between the device and a space or opening when the device is inserted therein.

In one embodiment of the invention, the space access device includes a housing and a securing mechanism disposed on at least an outer portion of the housing, the securing mechanism being configured to contact a surface of an internal space or opening and secure the device in the internal space or opening when the device is inserted therein.

In some embodiments of the invention, the securing mechanism is further configured to provide at least one path for fluid flow therethrough.

In some embodiments, the securing mechanism is configured to provide at least one path for fluid flow through the securing mechanism and a contact surface.

In some embodiments of the invention, the securing mechanism has at least one, more preferably, a plurality of contact points that are configured to contact a surface of an opening or internal space.

In some embodiments of the invention, the securing mechanism is configured to apply a pressure to a contact surface within a space or opening less than approximately 10000 kPa, more preferably, less than approximately 500 kPa when an access device having a securing mechanism disposed on an outer surface thereof is inserted in the space or opening.

In some embodiments, the contact pressure is preferably in the range of approximately 0.01 kPa-10 kPa.

In some embodiments of the invention, the space access device comprises an anatomical space access device.

In some embodiments of the invention, the space access device comprises an in-ear head set or in-ear head-phone.

In some embodiments of the invention, the space access device comprises a hearing instrument, such as a hearing aid or personal sound amplification product.

Advantages of the invention include the provision of biological and non-biological space access devices and systems that are capable of engaging a surface of an internal space or opening for an extended period of time, and include means for self-conforming or self-adjusting to the shape of the internal space or opening, means for adjusting the force applied to the surface of the internal space or opening, means for more evenly distributing the force applied to the surface of the internal space or opening, and means for fluid flow through and/or between the device and the internal space or opening when the device is inserted therein.

BRIEF DESCRIPTION OF THE DRAWINGS

Further features and advantages will become apparent from the following and more particular description of the preferred embodiments of the invention, as illustrated in the accompanying drawings, and in which like referenced characters generally refer to the same parts or elements throughout the views, and in which.

DETAILED DESCRIPTION OF THE PREFERRED EMBODIMENT

Figure 1:
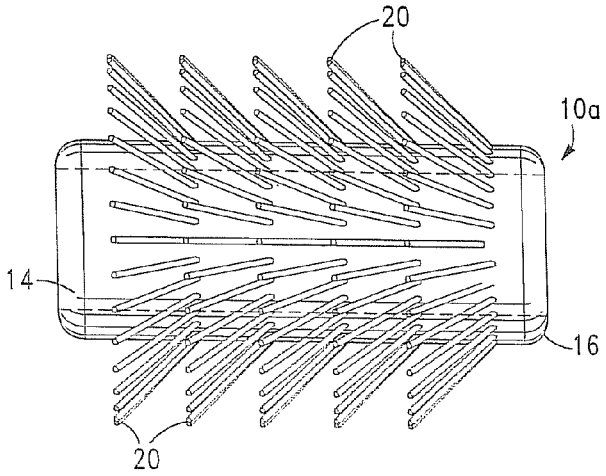
FIG. 1 is a side plan view of one embodiment of a securing mechanism, according to the invention.

Before describing the present invention in detail, it is to be understood that this invention is not limited to particularly exemplified apparatus, systems, structures or methods as such may, of course, vary. Thus, although a number of apparatus, systems and methods similar or equivalent to those described herein can be used in the practice of the present invention, the preferred apparatus, systems, structures and methods are described herein.

It is also to be understood that, although the securing mechanism structures and systems of the invention are illustrated and described in connection with anatomical space access devices and systems, the securing mechanism structures and systems of the invention are not limited to anatomical space access devices and systems. According to the invention, the securing mechanism structures and systems of the invention can be employed on any anatomical, i.e. biological, space access device or system, e.g. an in-ear head set, and non-biological space access device or system, e.g., inspection systems for fluid flow pipes and/or conduits, etc.

It is also to be understood that the terminology used herein is for the purpose of describing particular embodiments of the invention only and is not intended to be limiting.

Unless defined otherwise, all technical and scientific terms used herein have the same meaning as commonly understood by one having ordinary skill in the art to which the invention pertains.

Further, all publications, patents and patent applications cited herein, whether supra or infra, are hereby incorporated by reference in their entirety.

Finally, as used in this specification and the appended claims, the singular forms "a, "an" and "the" include plural referents unless the content clearly dictates otherwise. Thus, for example, reference to "a bristle" includes two or more such bristles and the like.

DEFINITIONS

The term "outwardly projecting member", as used in connection with a securing mechanism of the invention, means and includes any projection extending from a base member, including, without limitation, fins, bristles, protrusions, ridges, grooves, bubbles, balloons, hooks, looped structure and/or tubes.

The term "space access device", as used herein, means and includes anatomical or biological and non-biological devices that are designed and adapted to be inserted into a space or opening, such as an ear canal, nasal conduit, esophagus, airway, gastro-intestinal tract, blood vessel, pipe, or conduit.

The terms "headphone" and headset" are used interchangeably herein and mean and include a listening device that is adapted to receive transmitted sound via wireless or wired communication means. As is well known in the art, conventional headphones and headsets typically include one or more speakers and/or sound production components, which can be in the form of one or two earpieces (often referred to as "ear plugs" or "ear buds").

The following disclosure is provided to further explain in an enabling fashion the best modes of performing one or more embodiments of the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

As will readily be appreciated by one having ordinary skill in the art, the present invention substantially reduces or eliminates the disadvantages and drawbacks associated with conventional securing means for space access devices.

In overview, in some embodiments, the present invention is directed to securing mechanisms that can be readily employed with devices and systems that are configured to be inserted in one or more biological spaces or openings, such as an ear canal.

In some embodiments, the present invention is directed to anatomical, i.e. biological, and non-biological space access devices and systems having securing mechanisms that (i) securely engages a surface of an internal space or opening for an extended period of time, (ii) include means to self-conform or self-adjust to the shape and size of an internal space or opening, (iii) includes means for adjusting the force applied to a surface of an internal space or opening, (iv) includes means for more evenly distributing the force applied to the surface of the internal space or opening, and (iv) includes means for fluid flow between the device and biological space when the device is inserted therein.

As discussed in detail below, the securing mechanisms of the invention preferably include at least one, more preferably, a plurality of outwardly projecting members, which, according to the invention, can comprise, without limitation, fins, bristles, protrusions, ridges, grooves, balloons, bubbles, hooks, looped structures and/or tubes.

Figure 2:
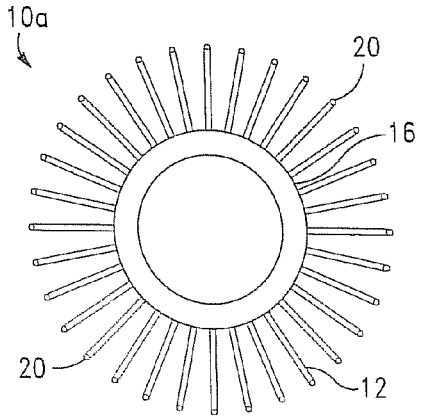
FIG. 2 is a front plan view of the securing mechanism shown in FIG. 1, according to the invention.

According to the invention, the outwardly projecting members can comprise separate members, i.e. engaged to a base component or, as illustrated in FIGS. 1 and 2, integral members 20 projecting from a base 16.

According to the invention, the securing mechanisms and/or projecting members thereof can comprise various conventional compliant and flexible materials, including, without limitation, silicone, rubber, latex, polyurethane, polyamide, polyimide, nylon, paper, cotton, polyester, polyurethane, hydrogel, plastic, feather, leather, wood, and Nitinol®. In some embodiments of the invention, the securing mechanisms and/or projecting members comprise a polymeric material.

As set forth in U.S. application Ser. No. 14/032,310, which is incorporated by reference herein in its entirety, the projecting members can have the same length or may have varying lengths. For example, bristles may have lengths greater than, less than, or falling between any of the following: 0.1 mm, 0.2 mm, 0.3 mm, 0.4 mm, 0.5 mm, 0.7 mm, 1 mm, 1.5 mm, 2 mm, 2.5 mm, 3 mm, 3.5 mm, 4 mm, 4.5 mm, 5 mm, 5.5 mm, 6 mm, 7 mm, 8 mm, 9 mm, 1 cm, 1.1 cm, 1.2 cm, 1.3 cm, 1.5 cm, 1.7 cm, 2 cm, 2.5 cm, or 3 cm.

The projecting members can also have any cross-sectional shape and size, including varying shapes and thicknesses (or diameters). For example, the projecting members may be flat, rounded, elliptical, square, triangular and/or hexagonal. The projecting members may have a diameter, length, or width, greater than, less than, or falling between any of the following, 1 μm, 2 μm, 3 μm, 5 μm, 7 μm, 10 μm, 15 μm, 20 μm, 30 μm, 50 μm, 75 μm, 100 μm, 125 μm, 150 μm, 200 μm, 300 μm, 500 μm, 1 mm, 2 mm or 3 mm.

In some embodiments of the invention, the securing mechanisms and/or projecting members comprise a coated, preferably, compliant and flexible material. According to the invention, the base material can be coated with various materials and compositions to enhance the lubricity, alter the friction, adjust the hydrophobicity, or increase the stability in the chemical, environmental, and physical conditions of the target space or opening of the projecting members.

The base material can also be coated with or contain various materials to allow for administration of a pharmacological agent or composition to biological tissue.

The coating material can thus comprise, without limitation, active agents or drugs, such as anti-inflammatory coatings, and drug eluting materials.

The coating material can also include non-pharmacological agents.

In a preferred embodiment of the invention, the securing mechanisms of the invention are designed and adapted to self-conform or self-adjust to the shape of the interior surface of an opening (or interior space) of a member (biological or non-biological) when an access device of the invention and, thereby, the projecting members are inserted in the opening and in a constrained state. In some embodiments of the invention, each projecting member is adapted to flex and/or deform to conform to the shape and/or size of the interior surface. In some embodiments of the invention, one or more member(s) is adapted to flex and/or deform to conform to the shape and/or size of the interior surface.

Figure 3A:
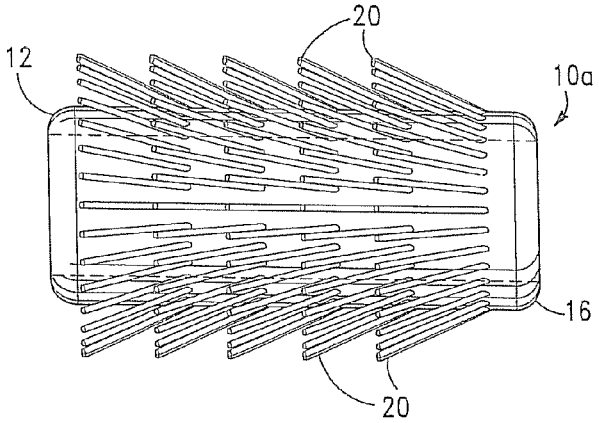
FIG. 3A is a side plan view of the securing mechanism shown in FIG. 1 in a collapsed state, according to the invention.
Figure 3B:
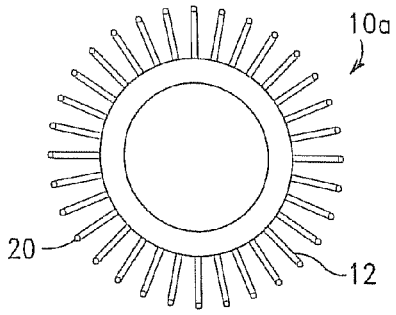
FIG. 3B is a front plan view of the securing mechanism shown in FIG. 1 in a collapsed state, according to the invention.
Figure 4A:
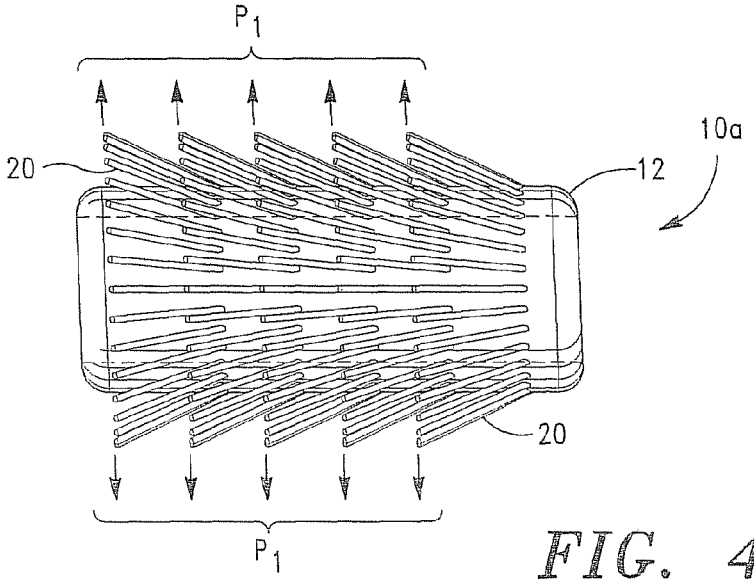
FIG. 4A is a further side plan view of the securing mechanism shown in FIG. 1 in a collapsed state and showing the forces provided thereby, according to the invention.
Figure 4B:
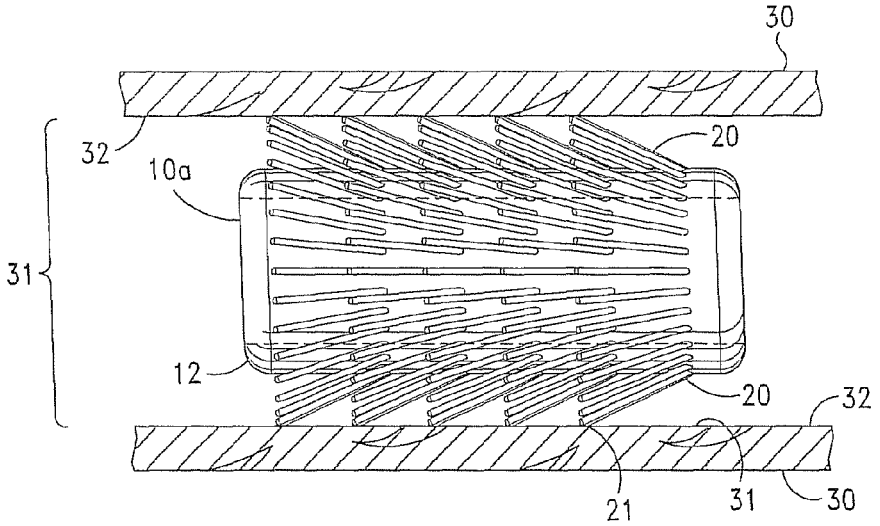
FIG. 4B is a further side plan view of the securing mechanism shown in FIG. 1 inserted in an opening, according to the invention.

By way of illustration, in the embodiment shown in FIGS. 4A and 4B, the projecting members 20 are designed and adapted to flex and deform, whereby the securing mechanism 12 self-conforms to the shape of the interior surface 32 of the opening 31 of member 30 when the access device 10A is inserted in the opening 31 and the projecting members 20 are in a constrained state (see, e.g., FIGS. 3A and 3B).

Figure 6:
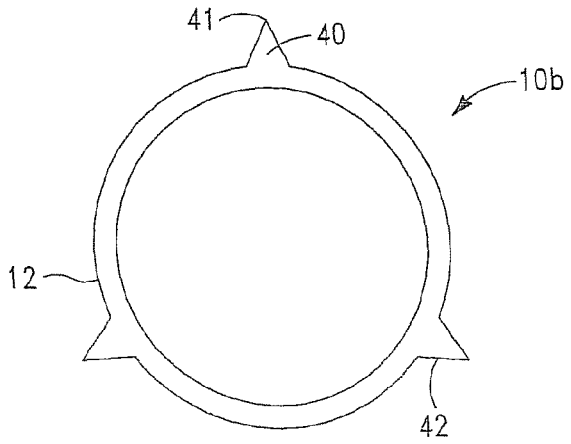
FIG. 6 is a front plan view of another embodiment of a securing mechanism, according to the invention.
Figure 7:
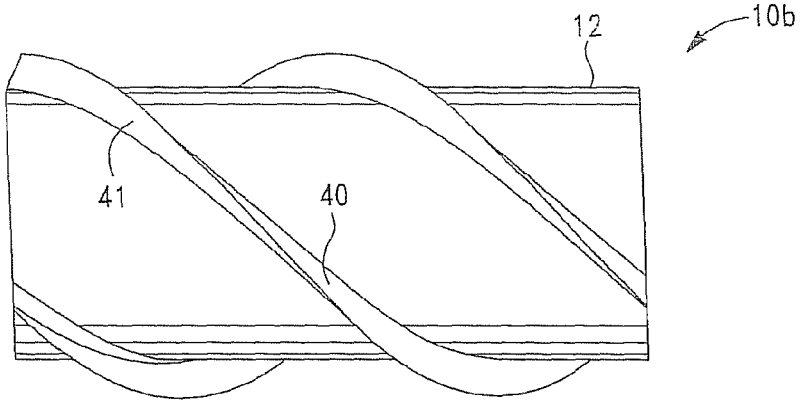
FIG. 7 is a side plan view of the securing mechanism shown in FIG. 6 having a spiral projecting or contacting member, according to the invention.

Referring to FIGS. 6 and 7, in the illustrated embodiment, each of the projecting members 40 are similarly designed and adapted to flex and deform, whereby the securing mechanism 42 self-conforms to the shape of the interior surface of a member opening when the access device 10B is inserted in the opening and the projecting members 40 are in a constrained state.

In a preferred embodiment of the invention, each projecting member of the invention is also configured and adapted to provide at least one contact point with an opening (or interior space) of a member (biological or non-biological) when an access device of the invention is inserted in the opening or space. According to the invention, the contact point(s) can be provided by design or by application. In other embodiments, the access device is configured and adapted such that one or more projecting members or a majority of the members provide at least one contact point with an opening or space.

Referring back to FIG. 4B, in the noted embodiment, each of the projecting members 20 accordingly includes or provides a contact point 21 at the interface 31 of each projecting member 20 and the interior surface 32 of the member 30.

As illustrated in FIGS. 6 and 7, each of the projecting members 40 similarly includes or provides a contact point 41 that is configured and adapted to contact the interior surface of an opening when the access device 12 is inserted therein.

According to the invention, the securing mechanisms of the invention are also preferably designed and adapted to apply a pressure (denoted by Arrows "$p_1$" in FIG. 4A) to the interior surface of a member opening or interior space (biological or non-biological) when an access device of the invention, e.g. 10A, 10B and/or 10C, is inserted in the opening and the projecting members are in a constrained state (see, e.g., FIGS. 3A and 3B). In some embodiments of the invention, each projecting member, e.g., projecting member(s) 20 and/or 40, is adapted to apply a pressure (or force) to the interior surface of a member opening.

In some embodiments of the invention, the pressure, $p_1$, is preferably in the range of 0.0005 kPa-10000 kPa. In some embodiments of the invention, the pressure, $p_1$, is preferably in the range of 0.01 kPa-2500 kPa. In some embodiments of the invention, the pressure, $p_1$, is preferably in the range of 0.005 kPa-500 kPa. In some embodiments of the invention, the pressure, $p_1$, is preferably in the range of 0.05 kPa-10 kPa.

In some embodiments of the invention, the noted force ranges are provided by varying the number of projections, and/or the pattern of the projections, and/or the pattern of the projections, and/or the size and shape of the projections, and/or the flexibility of the projections, and/or the material(s) comprising the projections, and/or the coating on the material(s) comprising the projections, and/or the surface features of the material(s) comprising the projections, and/or the projection angle with respect to the base and/or contact surface.

As stated above, the securing mechanism also preferably includes means for fluid flow through the device and/or between the device and an opening or space when the device is inserted therein. In some embodiments of the invention, the securing mechanism includes one or more fluid flow channels. In some embodiments, the flow channels are between the securing mechanism (or projections thereof) and a contact surface.

In some embodiments, the securing mechanism includes a compressible or flexible portion that is permeable to air.

In some embodiments, the securing mechanism includes one or more subsets of the outwardly projecting members, e.g., bristles, protrusions, ridges, grooves, bubbles, balloons, hooks and/or tubes. According to the invention, the subsets can comprise separate members that are attachable via a thin pliable membrane of the same or different material.

According to the invention, the noted membrane can serve to reduce fluid flow through the separate members. This may be useful, for instance, to further increase sound isolation when the securing mechanism is employed with an in-ear hearing device. In a preferred embodiment, the pliable membrane would, however, still allow for individual movements of the separate members so many of the advantages of conformability are intact.

In some embodiments of the invention, the membrane restricts (or slows down) fluid flow proximate the securing mechanism, including space access devices and systems in which there exists and in which there does not exist one or more direct paths for fluid to flow through the securing mechanism from one end of the securing mechanism to the other.

In some embodiments, the membrane completely blocks fluid flow from one end of the securing mechanism to the other.

As indicated above, FIGS. 1 through 4B illustrate an anatomical space access device 10A that includes one embodiment of a securing mechanism 12 of the invention. As discussed above, the securing mechanism includes a plurality of outwardly projecting members 20 that are designed and adapted to flex and deform (see, e.g., FIGS. 3A and 3B), whereby the securing mechanism 12 self-conforms to the shape of the interior surface of a member opening when the access device 10A is inserted in the opening and the projecting members 20 are in a constrained state (see, e.g., FIG. 4B).

Each of the projecting members 20 of the access device also includes or provides a potential contact point at the interface of each projecting member and the interior surface of the member opening when the access device 10A is disposed therein.

FIGS. 6-7 illustrate another anatomical space access device 10B that includes another embodiment of a securing mechanism 42 of the invention. As also discussed above, the securing mechanism 42 includes at least one, more preferably, a plurality of outwardly projecting members 40 that are designed and adapted to flex and deform, whereby the securing mechanism 42 self-conforms to the shape of the interior surface of a member opening when the access device 10B is inserted in the opening and the projecting members 40 are in a constrained state.

In some embodiments of the invention, the projecting members 40 extend across a defined length of the device 10B. As illustrated in FIG. 7, in some embodiments, the projecting members 40 extend across the entire length of the device 10B.

According to the invention, the projecting members can have various configurations. In the embodiment shown in FIG. 7, the projecting members 40 have a spiral configuration.

Figure 8:
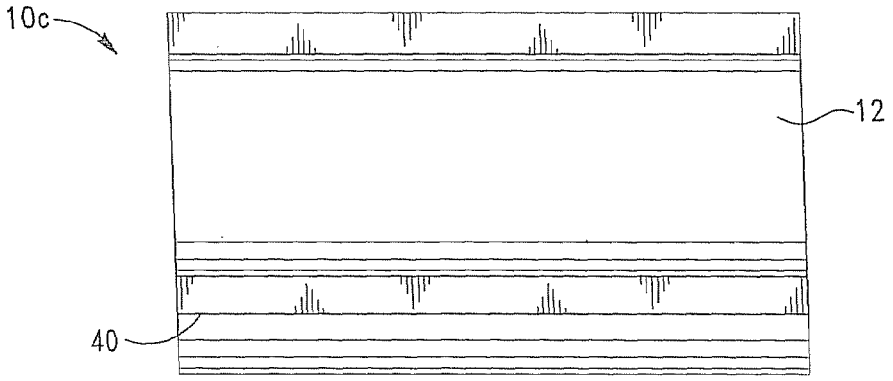
FIG. 8 is a side plan view of the securing mechanism shown in FIG. 6 having a linear contacting member, according to the invention.

In the embodiment shown in FIG. 8, the projecting members 40 have a substantially straight or liner configuration, which, preferably, extends across the entire length of the access member 10C.

Each of the projecting members 40 of the access devices 10B, 10C similarly includes or provides a contact point 41 at the interface of each projecting member 40 and the interior surface of a member opening when the device (10B or 10C) is disposed therein.

According to the invention, the space access devices of the invention, e.g., 10A, 10B and/or 10C can comprise any device that is designed to be inserted into a biological space or opening, such as an ear canal, nasal opening, etc. (see, for example, FIG. 5).

In some embodiments of the invention, the space access device includes an electronics-containing portion or region 14 (see, e.g., FIG. 1) that is adapted to receive various electronic components and associated circuitry, such as sensor systems, receivers, amplifiers, batteries, antennae, speakers, energy generating and dissipating means, microphones, sensors, communication modules, pressure sensors, wireless communication components, wired communication components, etc.

The space access devices of the invention can thus comprise various conventional anatomical and non-anatomical devices and systems, such as physiological sensors, conduit inspection systems, flow sensors, flow restrictors, fluid samplers, pressure sensors, sound or vibration actuators, accelerometers, and mechanisms for releasing particles or fluids into conduits or other fluids, etc. The space access devices can also comprise a radio system or component thereof, e.g., receiver, transmitter, transceiver, microphone, microcontroller, etc.

As set forth in detail in Co-Pending application Ser. No. 12/841,120; which is expressly incorporated by reference herein in its entirety, the space access devices can also comprise a hearing apparatus, such as a hearing prosthesis or aid.

The space access devices can additionally comprise headphones or a headset for a portable electronic device, such as a GPS device, CD or DVD player, MPEG player, MP-3 player, cell phone, personal digital assistant (PDA), tablet, laptop, video game system, audio guide system, phone, musical instrument, stethoscope and other medical or industrial instrumentation, smart phone, computer, etc., and/or a combination thereof.

As discussed in detail below, the space access devices can also comprise headphones (or a headset) for augmented reality glasses, head-mounted displays, and/or heads-up displays.

As is well known in the art, there are a wide variety of headset types, including over-ear headsets, around-ear headsets, on ear headsets, in-concha headsets, in-ear headsets, etc. Each type of head set has advantages and disadvantages with regard to sound quality, ease of use, aesthetics, user comfort, etc.

Two popular headset designs are the in-concha headset and the in-ear headset. The in-concha headset design generally includes a speaker that is, when properly positioned, received within the concha of the ear of a user (generally the area of the ear surrounding the opening of the ear canal). The in-ear headset design generally includes a speaker and/or insert that is at least partially received within the ear canal of a user when properly positioned. These designs are typically compact and are often supported by a small structure that is secured to the external portion of the ear (e.g., with an ear hook) and/or supported and/or retained within the ear by the concha or ear canal in what amounts to an interference fit.

A major drawback of both the in-concha and in-ear headsets is that wearers often experience discomfort after a period of time of use. The discomfort can be due to one or more of the fitment or breathability of the headset, the type of material of which the headset is composed, the pressure of the headset on the surface of the ear canal, or simply sensitive ears.

A further drawback of in-concha and in-ear headsets is that they are also easily dislodged during various activities of the wearer, e.g., jogging.

A further drawback of in-concha and in-ear headsets is that they often fail at maintaining a good alignment between the speaker and the ear canal, which may result in inconsistent sound quality and/or sound volume.

A further drawback of in-concha and in-ear headsets is that they often limit the amount of ambient sound that enters the ear canal, which can reduce the wearer's environmental awareness and ability to interact with the environment and others in the environment.

Another drawback is that some headsets require components that need to be molded for a specific user to achieve the desired fit.

By employing a securing mechanism of the invention with in-concha and in-ear headsets the noted discomfort can, however, be substantially reduced or eliminated. The securing mechanism will also enhance the engagement and hold of the head set in the concha or ear canal(s). The securing mechanism will also enhance the alignment of the headset with the ear canal(s). The securing mechanism will also enhance the ability to hear ambient sounds.

Figure 5:
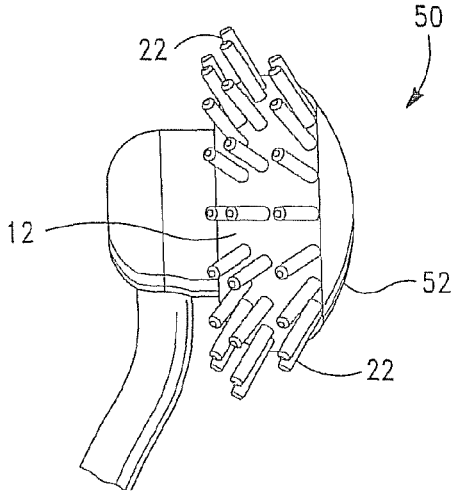
FIG. 5 is a side plan view of one embodiment of an in-ear head set or ear bud or hearing instruments having a securing mechanism associated therewith, according to the invention.

Referring now to FIG. 5, there is shown one embodiment of an earpiece speaker system (i.e. in-concha or in-ear headset) 50 having a securing mechanism of the invention associated therewith. According to one aspect of the invention, the earpiece speaker system 50 includes an earpiece body 52 through which an audio signal is provided, the earpiece body 52 having a securing mechanism 12, a speaker mount surface, and a plurality of speaker modules interchangeably mountable to the body.

As illustrated in FIG. 5, the securing mechanism 12 includes a plurality of outwardly projecting members 22. In a preferred embodiment of the invention, the outwardly projecting members comprise a plurality of the bristles, such as the aforementioned bristles and bristles disclosed in Co-Pending application Ser. No. 12/841,120.

According to the invention, the securing mechanism 12 can also comprise the mechanism 42 shown in FIGS. 6, 7 and 8 having projecting members 40.

The securing mechanism 12 can alternatively comprise or include outwardly projecting protrusions, ridges, grooves, bubbles, balloons, hooks and/or tubes.

According to the invention, the securing mechanism 12 (or 40) similarly applies a pressure, $p_1$, to an interior surface of the ear canal less than 10000 kPa. In some embodiments of the invention, the pressure, $p_1$, is preferably in the range of 0.01 kPa-2500 kPa. In some embodiments of the invention, the pressure, $p_1$, is preferably in the range of 0.005 kPa-500 kPa. In some embodiments of the invention, the pressure, $p_1$, is preferably in the range of 0.05 kPa-10 kPa.

As will readily be appreciated by one having ordinary skill in the art, the noted pressure exerted to an interior surface of the ear canal by the securing mechanism 12 (or 40) will effectively engage and hold a headset in the concha or ear canal(s) and enhance the alignment of the headset with the ear canal(s), without discomfort to a wearer.

As indicated above, the noted earpiece speaker system (i.e. in-concha or in-ear headset) 50 can readily be employed with, i.e. a component of, a variety of portable electronic devices, such as a GPS device, CD or DVD player, MPEG player, MP-3 player, cell phone, personal digital assistant (PDA), tablet, laptop, video game system, audio guide system, phone, musical instrument, stethoscope and other medical or industrial instrumentation, smart phone, computer, etc., and/or a combination thereof.

As also indicated above, the noted earpiece speaker system, i.e. headphones (or a headset) can also be readily employed with, i.e., a component of, augmented reality glasses. According to the invention, communications by and between the headphones (i.e. ear buds) and augmented-reality eyewear, such as GPS directions, phone calls, music, notifications, audio information, etc., can be achieved via conventional wireless systems and associated protocol, including, without limitation, radio frequency (RF) communication, electromagnetic coupling, optical communication (e.g., laser), physical conduction, sound conduction (potentially lower volume or less audible frequencies), electronic signals, etc. Communications by and between the headphones and augmented-reality eyewear can also be achieved via wired connections.

By virtue of the unique securing means (12 or 40) of the invention, a user of augmented reality eyewear and a space access device, i.e. headphones or headset, of the invention, will be allowed to hear ambient sounds emanating from the surrounding environment, such as vehicles, people, crossing signals, etc., while receiving direct transmissions from the glasses, e.g., GPS directions, in both ears. Further, by virtue of the directionality and proximity of the receiving transmitters/speakers/receivers that can be employed with the space access devices of the invention, those in the surrounding environment will hear little or none of the transmissions emanating from the eyewear, headphones, or headset.

The noted earpiece speaker system. i.e. headphones (or a headset) can also be readily employed with, i.e., a component of, heads-up displays. According to the invention, communications by and between the headphones and heads-up displays can similarly be achieved via conventional wireless systems and associated protocol, including, without limitation, RF communication, electromagnetic coupling, optical communication, physical conduction, sound conduction, electronic signals, etc., and wired connections.

By virtue of the unique securing means of the invention, a user of a heads-up display and a space access device of the invention will also be allowed to hear ambient sounds emanating from the surrounding environment, including people in close proximity to the user, while receiving transmissions from the heads-up display in both ears. As indicated above, by virtue of the directionality and proximity of the receiving transmitters and/or speakers and/or receivers that can be employed with the space access devices of the invention, those in the surrounding environment will hear little or none of the transmissions emanating from the heads-up display.

As will readily be appreciated by one having ordinary skill in the art, the space access devices of the invention can also be readily adapted and, hence, effectively employed to receive transmissions and/or communications from various electronic devices, such as field radios, as well as the aforementioned portable electronic devices, augmented-reality eyewear and heads-up displays, when ambient sounds emanating from the surrounding environment are muffled via a secondary head set.

For example, in a military environment when large artillery is being fired, those in close proximity to the artillery often wear sound deadening headsets to muffle the sounds emanating from the artillery. To receive instructions or commands from a superior, the sound deadening head set must thus be partially or fully removed. As one can readily appreciate, partially or fully removing the sound deadening headset will expose the wearer to the harsh and potentially damaging sounds emanating from the artillery or other explosions, machinery, or gun fire.

Further, in most instances, a physical signal, such as a tap on a shoulder or a hand gesture, is necessary to alert the wearer of a sound deadening head set that communication with another person is necessary or desired. This can, and in most instances will, delay communications by and between the wearer and another person, which could result in serious injury or death in an emergency situation.

By employing a space access device of the invention, instantaneous communications by and between a wearer of a sound deadening headset is facilitated without the need to partially or fully remove the head set. The wearer of a sound deadening head set will also remain protected from the potentially damaging ambient noise while being able to receive direct verbal communications from others, as well as communications from external devices.

As will be appreciated by one having ordinary skill in the art, not only will use of the space access device(s) of the invention be beneficial to military personnel, but beneficial to police, fire fighters, secret service, homeland security, and like personnel as well. As indicated above, the space access device(s) of the invention will allow such personnel to hear sound transmitted from their earphones (e.g., radio communications) while being able to hear and locate sounds emanating from the surrounding environment, such as footsteps, gun shots, voices of others, etc.

A unique and seminal feature of the space access devices of the invention is that they allow the user to hear transmissions in BOTH ears (which allows for clearer listening as well as receipt of stereo signals) while still being able to hear the surrounding environment. Currently, people desirous of hearing both the sound transmitted from the headset and sound from the surrounding environment will use one ear bud (placed in one ear) or position a headset over one ear. This only allows "mono" sound to be received by the user (as opposed to stereo) and also adversely affects the ability of the user to locate where ambient sounds are emanating from.

As will readily be appreciated by one having ordinary skill in the art, the present invention provides numerous advantages compared to prior art methods and systems for securing space access devices in internal spaces and openings. Among the advantages are the following:

The provision of biological and non-biological space access devices and systems that are capable of engaging a surface of an internal space or opening for an extended period of time.

The provision of biological space access devices and systems that are capable of comfortably engaging a surface of an internal body space or opening for an extended period of time.

The provision of provision of biological and non-biological space access devices and systems that are capable of engaging a surface of an internal space or opening, and include means to self-conform or self-adjust to the shape of the internal space or opening.

The provision of provision of biological and non-biological space access devices and systems that are capable of engaging a surface of an internal space or opening, and include means for adjusting the force applied to the surface of the internal space or opening.

The provision of provision of biological and non-biological space access devices and systems that are capable of engaging a surface of an internal space or opening, and include means for fluid flow through and/or between the device and the internal space or opening when the device is inserted therein.

Without departing from the spirit and scope of this invention, one of ordinary skill can make various changes and modifications to the invention to adapt it to various usages and conditions. As such, these changes and modifications are properly, equitably, and intended to be, within the full range of equivalence of the invention.

What is claimed is:

1. A securing mechanism for a space access device, comprising:

a base comprising a longitudinal axis and an outer surface, said securing mechanism further comprising a plurality of projecting members disposed circumferentially around said base, said plurality of elongated members comprising at least 10 of said plurality of elongated members, each of said plurality of elongated members having a proximal end, distal end and a rounded cross-sectional shape that varies in diameter from said proximal end to said distal end, wherein each of said projecting members comprises a length to diameter ratio from said proximal end to said distal end in the range of 2:1 to 10:1, said proximal ends of said plurality of projecting members being connected to said outer surface of said base and projecting outwardly therefrom at an angle relative to said base longitudinal axis in the range of 45°-65°, said distal ends of said plurality of projecting members defining a plurality of contact points that are configured to contact a surface of an opening when disposed on an outer surface of a space access device that is inserted in said opening, each of said plurality of projecting members being further configured to apply a pressure to said opening surface when said space access device is disposed in said opening less than approximately 10000 kPa.

2. The space access device of claim 1, wherein said securing mechanism applies a pressure to said opening surface when said space access device is disposed in said opening in the range of approximately 0.01 kPa-10 kPa.

3. The space access device of claim 1, wherein said space access device comprises an anatomical space access device.

4. The space access device of claim 1, wherein said space access device comprises an in-ear head set.

* * * * *